United States Patent [19]

Herr et al.

[11] 4,107,591

[45] Aug. 15, 1978

[54] HALL GENERATOR POSITION SENSING DEVICE

[75] Inventors: John A. Herr, Garwood; Wolfgang Jaffe, Roselle Park, both of N.J.

[73] Assignee: The Singer Company, New York, N.Y.

[21] Appl. No.: 787,391

[22] Filed: Apr. 14, 1977

[51] Int. Cl.[2] ..... H01F 13/00

[52] U.S. Cl. ..... 318/663; 361/148

[58] Field of Search ..... 361/148; 318/663

[56] References Cited

U.S. PATENT DOCUMENTS

| | | | |
|---|---|---|---|
| 3,235,776 | 2/1966 | Ireland | 361/148 |
| 3,596,144 | 7/1971 | Cunningham | 361/148 |
| 3,708,727 | 1/1973 | Wielebski | 361/148 |

*Primary Examiner*—B. Dobeck

*Attorney, Agent, or Firm*—Robert E. Smith; Edward L. Bell; William V. Ebs

[57] ABSTRACT

A position sensing device is disclosed including an assembly of a Hall effect generator element shiftably supported relatively to a permanently magnetizable element. Each such Hall effect generator element being randomly chosen from an inventory of parts having wide tolerance limits of Hall effect output under like magnetic flux influence; and each magnetizable element from an inventory having a widely varying magnetic capability after exposure to like magnetizing influence. The magnetization of the magnetizable element of each such assembly being imparted thereto under control of the Hall effect output of the specific Hall effect generator in the assembly with the result that every position sensing device so assembled can be made to produce substantially identical Hall effect output in each relative position of said elements.

4 Claims, 8 Drawing Figures

HALL GENERATOR POSITION SENSING DEVICE

BACKGROUND OF THE INVENTION

This invention pertains to the field of brushless position sensing devices. Such devices find utility, for instance, in servo systems for providing signals related in a known way to the actual position of the device being controlled.

Wire wound potentiometers and devices requiring commutation have been used heretofor as position sensing devices, but they involve brush wear which adversely influences longevity.

Hall effect generators which have been used in position sensing devices such as that disclosed in the U.S. Pat. No. 3,365,594, Jan. 23, 1968, of R. S. Davidson, Jr., do not provide an output which is predetermined in value but require an expensive amplifier such as that designated at 31 in the referenced patent in order to provide useable interface with related equipment. Amplifiers and the like in prior art devices of this nature can only exert limited influence on the Hall effect output, such, for instance as influence on the maximum value of the output. There are no simple techniques for tailoring the Hall effect output over the entire range of relative position being sensed.

SUMMARY OF THE INVENTION

It is an object of this invention to provide a brushless position sensing device which may be assembled using randomly selected components having wide tolerance variations and in which the output Hall effect voltages of all such assembled sensing devices can be depended upon to be substantially identical in any of the positions sensed. This object of the invention is attained by utilizing the output of the Hall generator of each position sensing device to control the treatment to which that device is subjected during manufacture, particularly as to intensity of magnetization which influences the Hall effect voltages generated by the position sensing device.

Depending upon the complexity of the curve of Hall effect output voltages which is desired throughout the path of relative movements between the elements of the position sensing device, and depending upon the accuracy of response required, various different modes of magnetic inducement are possible. Thus a single pair of electromagnetic poles may be utilized simultaneously to induce magnetism in all of the different selected areas of the permanently magnetizable element and the shape of the electromagnet poles can be prearranged so as to influence the required variations in the induced magnetic intensity. Particular accuracy and the widest latitude in tailoring of the variations in induced magnetism, and therefore, the widest variation in resulting Hall effect voltage generation may be obtained by successive actuation of electromagnetic poles each of which is limited in size and in positional relationship to a particular area to be magnetized. In each different mode, however, the same Hall effect generator which will function in the resulting position sensing device to develop Hall effect voltages which are positionally indicative, will be used to control magnetic inducement in the same permanent magnet element which will remain in the device.

DETAILED DESCRIPTION OF THE INVENTION

Figure 1:
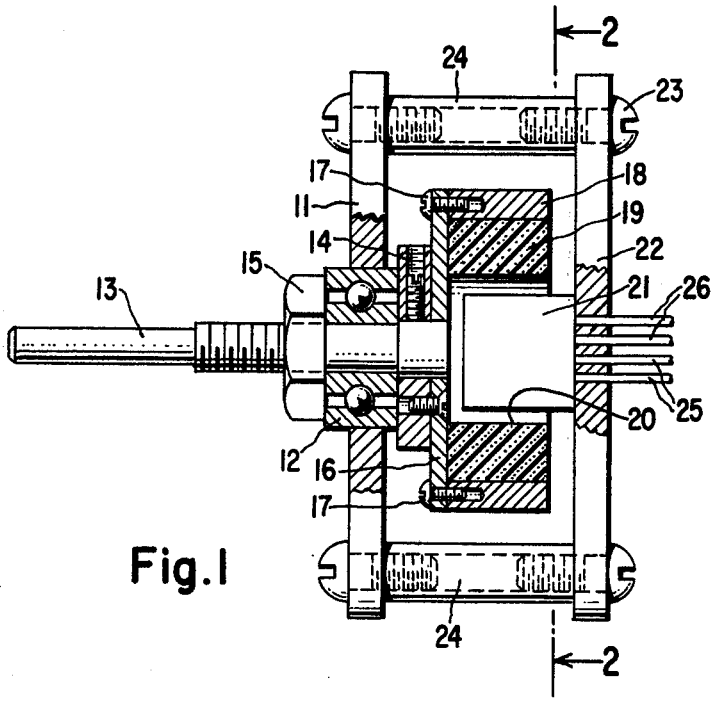
FIG. 1 is a cross-sectional view showing a preferred form of construction of a position sensing device embodying this invention.
Figure 2:
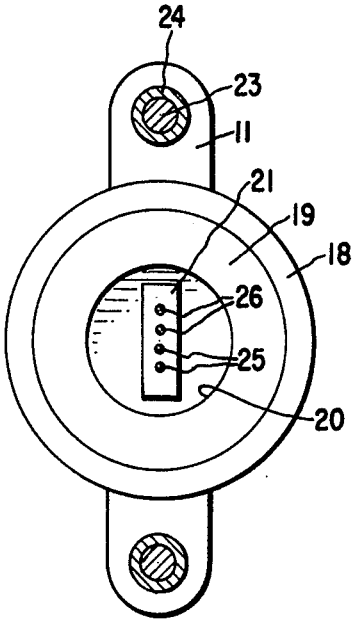
FIG. 2 is a cross-sectional view taken substantially along the 2–2 of FIG. 1.

As shown in FIGS. 1 and 2 a preferred form of the position sensing device of this invention comprises a frame plate 11 in which a bearing 12 is secured. A shaft 13 is journalled in the bearing and sustained axially therein by a collar 14 secured to the shaft and arranged at one side of the bearing and a fastener 15 threadedly engaging the shaft at the other side of the bearing. A backing plate 16, preferrably formed of non-magnetizable material, is fixed to the collar 14 and has secured as by screws 17 at its periphery a cylindrical rim 18 of ferrous material within which is fastened as by an adhesive or the like a torus shaped permanently magnetizable element 19. The element 19 is formed with a central circular bore 20 within which a thin flat substantially planar Hall effect generator element 21 is arranged.

Figure 3A:
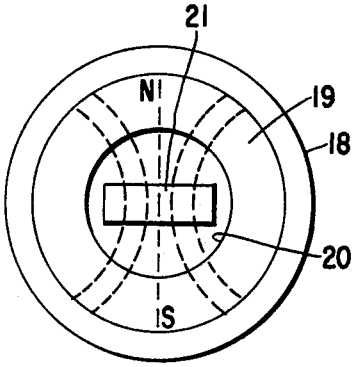
FIG. 3*a* is a diagramatic view of the magnet and Hall generator elements of the form of this invention illustrated in FIGS. 1 and 2 including a representation of the lines of magnetic flux and showing the position of parts for maximum Hall effect voltage generation.
Figure 3B:
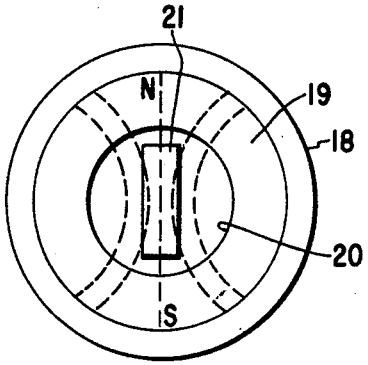
FIG. 3*b* is a diagramatic view similar to FIG. 3*a* but showing the position of parts for minimum Hall effect voltage generation.

The Hall generator element 21 is carried by a frame plate 22 which is assembled as a unit with the frame plate 11 by fastening bolts 23 with the frame plates being maintained a predetermined distance apart by spacers 24. Electrical leads 25—25 from the Hall generator element are provided by which a control current may be applied thereto. While electrical leads 26—26 carry the Hall effect voltage which is generated by the element 21. When the control current is maintained uniform, the Hall effect voltage will vary depending upon the density of magnetic flux passing transversely through the Hall effect generator. With the magnetized element magnetized transversely as illustrated in FIGS. 3*a* and 3*b*, magnetic lines of flux will traverse the central bore 20 of the magnetized element as indicated and the maximum Hall effect output will occur when the Hall effect generator element is positioned as shown in FIG. 3*a;* the minimum, as shown in FIG. 3*b*. An advantage of the construction illustrated in FIGS. 1–6 resides in the fact that only angular movement of the Hall effect generator has any appreciable effect on Hall effect output, lateral movement, in contrast, has practically no measurable influence. As a result this construction is not adversely influenced by vibration or the like.

Figure 7:
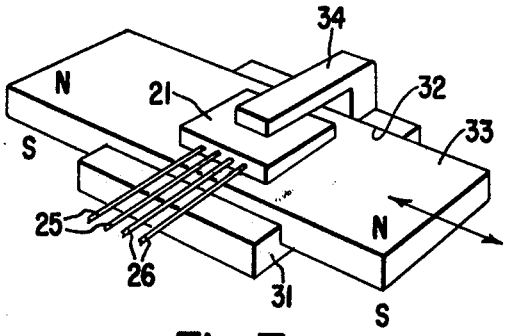
FIG. 7 is a perspective view illustrating a modified form of construction of a position sensing device of this invention.

Illustrated in FIG. 7 is a modified form of position sensing device in which a frame 31 is provided having a guide channel 32 in which a straight bar magnet 33 formed of permanently magnetizable material is slidable in the direction indicated by the arrows. A bracket arm 34 projecting from the frame 31 supports the thin flat substantially planar Hall effect generator element 21 contiguous to the bar magnet 33. The Hall generator element includes electrical leads 25—25 for the control current and the leads 26—26 for the Hall effect voltage. Depending upon the intensity of magnetization of the bar magnet 33 along the path of relative movement with respect to the Hall effect generator element 21, the Hall output voltage will vary and can thus provide an accurate indication of the relative position of the magnet element 33 with respect to the Hall generator element 21.

Because both of the relatively movable elements of the position sensing device of this invention, i.e. the permanently magnetizable element and the Hall generator element, will exhibit tolerance variation from predetermined norms it is impossible using batch processing of the elements to get assemblies which will deliver prescribed Hall effect voltages. This results from the fact that not only do identically formed Hall effect generator elements generate different Hall effect voltages when subjected to identical conditions of control current and magnetic flux, but identically formed and treated permanent magnet elements similarly retain varying amounts of magnetism.

Even if by using selective assembly, a few assemblies might possibly be arrived at which would deliver a prescribed Hall effect output at one given relative position of the parts, there is little likelihood that they would respond predictably over the entire range of relative positions.

As a result, the prior art Hall effect position sensing devices are each unique and they require complicated and expensive regulating and tuning devices, or they require individually tailored circuits and logic to be associated with them.

To be useful in a practical sense and with mass produced machinery, the position sensing device of this invention must be capable of assembly by random selection of parts and yet each such assembly must provide predictable Hall effect outputs throughout all relative positions of the parts.

Figure 4:
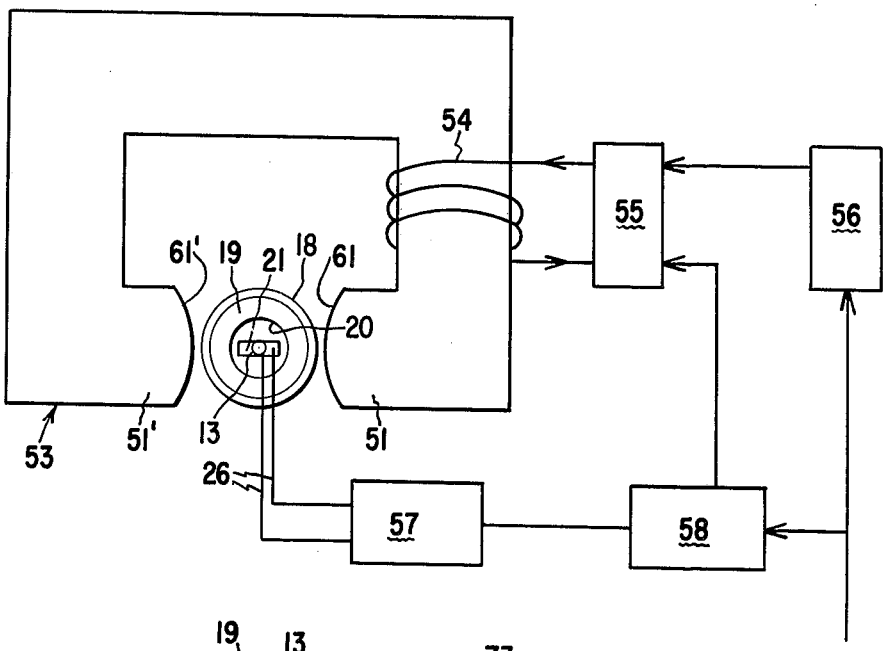
FIG. 4 is a diagramatic view of an arrangement of components of the position sensing device together with a means for inducing magnetism in the position sensing device and the basic elements of a control circuit for regulating the magnetic induction.
Figure 5:
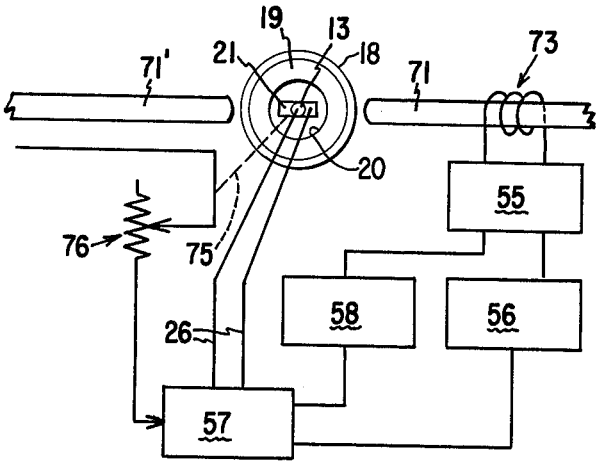
FIG. 5 is a diagramatic view of a modified form of the arrangement of FIG. 3 for regulating the process of inducing magnetism in the position sensing device.
Figure 6:
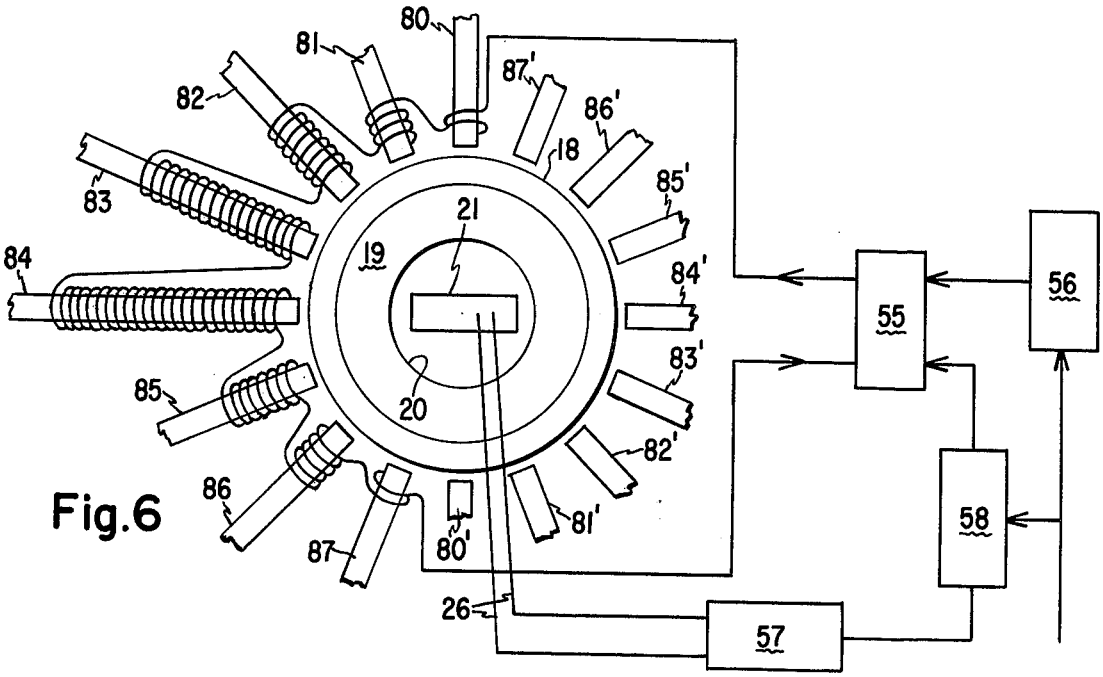
FIG. 6 is a diagramatic view of a further modified form of the arrangement of FIG. 3 for regulating the process of inducing magnetism in the position sensing device.

FIGS. 4, 5, and 6 illustrate three variations of a mode of treatment whereby predictably uniform output of the position sensing devices is attained. Although in FIGS. 4, 5, and 6, the construction illustrated in FIGS. 1-3 is shown by way of example, it will be understood that the construction of FIG. 7 or of any other modified form of construction may be similarly influenced.

As shown in FIG. 4 the assembly of permanently magnetizable element 19 and Hall generator element 21 is placed between the opposite poles 51-51' of an electromagnet indicated generally at 53 including an energizing coil 54. The elements 19 and 21 are adjusted into a predetermined relative position; any position may be chosen, the only criteria being that the required Hall effect voltage at that chosen predetermined position must be known. Indicated at 55 is an energy storage capacitor bank connected to the electromagnet energizing coil 54. The capacitor bank is charged first in response to a magnetization power supply 56 which serves to magnetize the magnet 19 to saturation. The Hall generator output 26—26 is then measured in a comparator 57 against the known or desired Hall effect response.

The comparator regulates the production of a series of calibrating pulses by a calibrating power supply 58. The calibrating pulses may be of a limited pulse width and are of the reverse direction from that supplied by the magnetizator power supply 56. These calibrating pulses reduce the magnetic output of the element 19 until the comparator 57 indicates that the desired level of magnetic intensity has been reached and stops the calibrating process. A conventional magnetizer such as the LDJ 2001 manufactured by LDJ Electronics of Troy, Michigan may be used to carry out this invention by substituting the Hall effect voltage in the leads 26—26 of the position sensing device of this invention in place of the Gaussmeter of the LDJ 2000 magnetizer. Since the same specific Hall effect element and magnetizable element are used to develop the signals used to control the inducement of magnetism as will be used thereafter in the operation of the position sensing device, every device thus assembled will exhibit the predetermined output response.

In the form shown in FIG. 4 the opposed faces 61-61' of the electromagnet poles 51-51' may be formed with any desired shape empirically designed to induce that gradient of magnetic intensity in the elements 19 which will provide the desired curve of Hall effect voltages over the entire range of relative positions of the parts.

FIG. 5 illustrates a modified arrangement for treating the position sensing device of this invention in which one pair of electromagnetic poles 71-71' of an electromagnet 73 is energized successively in varying degree to induce magnetism of predetermined intensity in selected areas circumferentially about the magnetic element 19. With this modification, the poles 71-71' are preferrably small in dimension so that during each successive magnetization only a limited area circumferentially about the magnetic element 19 will be influenced.

The same arrangement of capacitor bank 55, magnetization power supply 56, comparator 57 and calibration power supply 58 may be used as with the form shown in FIG. 4, however, with the version shown in FIG. 5, the position sensing device being treated must be shifted through its range of relative positions in successive steps during the magnetization treatment preferrably each step inducing the periphery of the magnet element 19 a distance equal to the width of the electromagnet 73. Connected mechanically as indicated at 75 to the shaft 13 of the position sensing device being treated is a potentiometer 76 providing a variable setting for the comparator 57 which may be tailored to provide any predetermined gradient for the resulting Hall effect voltage generation by the position sensing device. The leads 26—26 of the Hall generator being processed are connected to the comparator as in the version illustrated in FIG. 4.

Illustrated in FIG. 6 is a modified arrangement for treating the position sensing device of this invention which combines the features of the form shown in FIGS. 4 and 5. In the form shown in FIG. 6 magnetization is induced simultaneously in the entire magnetic element 19 as in FIG. 4 but individual selected areas circumferentially about the magnetic element 19 are magnetized individually in varying degree as in FIG. 5.

As many different electromagnets as are desired each with opposed pairs of poles 80-80' to 87-87' inclusive are arranged about the position sensing device to be treated and the successive electromagnets are each provided with that number of turns of wire which bears a direct proportional relation to the desired intensity of magnetization in the selected area contiguous to these electromagnet poles on the position sensing device.

The same arrangement of components of the magnetizer may be used as in the version shown in FIG. 4 and the Hall generator output of the position sensing device being treated is used via lines 26—26 to control the magnetizing step. When the required Hall effect response is attained in one known position of the parts, the variations in the windings of the electromagnets will automatically provide for the requisite gradient in the response of the device throughout the range of possible relative positions of the parts.

Having set forth the nature of this invention what is claimed herein is:

1. A brushless position sensing device comprising an element formed of permanently magnetizable material, a Hall effect generator element, means supporting said Hall effect generator element and said permanently magnetizable element in contiguous relation and for relative shifting movement therebetween in a prescribed path, selected areas of said permanently magnetizable element being magnetized in varied magnetic intensity along said path so as to produce throughout said path of relative shifting movement between said elements Hall effect voltage outputs of predetermined values, said magnetization being induced in said permanently magnetizable element under control of Hall effect voltages generated by a specific Hall effect generator element carried by said supporting means contiguous to a specific permanently magnetizable element during inducement of said magnetization.

2. A brushless angular position sensing device comprising:

a hollow cylindrical element formed of permanently magnetizable material, a thin flat substantially planar Hall effect generator element, means supporting said Hall effect generator element symmetrical to the axis of and substantially parallel to a diametrical plane within said hollow cylindrical element for relative rotation between said elements, said cylindrical element being magnetized transversely of said axis with diametrically arranged areas of opposite magnetic polarity which are varied in magnetic intensity circumferentially about said cylindrical element so as to produce throughout each quadrant of relative rotation between said cylindrical element and a specific Hall effect generator element a substantially linear Hall effect voltage output upon relative rotation of said elements, said magnetization being induced in said hollow cylindrical element under control of Hall effect voltages generated by said specific Hall effect generator element located within said hollow cylindrical element during inducement of said magnetization.

3. A brushless angular position sensing device as set forth in claim 2 in which said areas of varied magnetic intensity are induced in said hollow cylindrical element simultaneously by the action of a single pair of shaped poles of an electromagnet of which the actuation is controlled in accordance with the Hall effect voltage generated by said specific Hall effect generator element located in a predetermined angular position relatively to said hollow cylindrical element during inducement of said magnetization.

4. A brushless angular position sensing device as set forth in claim 2 in which said areas of varied magnetic intensity are induced in said hollow cylindrical element by the successive actuation of electromagnetic poles corresponding substantially in size and orientation to that of said individual areas of magnetic intensity each successive actuation being controlled in accordance with the Hall effect voltage generated by said specific Hall effect generator element located in a predetermined angular position relatively to said hollow cylindrical element during said successive actuation.

* * * * *